US009273491B2

(12) United States Patent
Yu

(10) Patent No.: US 9,273,491 B2
(45) **Date of Patent: *Mar. 1, 2016**

(54) LOCK HAVING AN INDICATORY LOCK CORE

(76) Inventor: Chun Te Yu, Changhua County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/205,674

(22) Filed: Aug. 9, 2011

(65) Prior Publication Data

US 2011/0289988 A1 Dec. 1, 2011

Related U.S. Application Data

(63) Continuation of application No. 12/213,031, filed on Jun. 13, 2008, now Pat. No. 8,011,212.

(30) Foreign Application Priority Data

Jun. 14, 2007 (TW) ..... 96121600 A

(51) Int. Cl.

| | |
|---|---|
| ***E05B 37/02*** | (2006.01) |
| ***E05B 37/00*** | (2006.01) |
| ***E05B 35/10*** | (2006.01) |
| *E05B 35/00* | (2006.01) |
| *E05B 39/00* | (2006.01) |

(52) U.S. Cl.

CPC ..... *E05B 37/0034* (2013.01); *E05B 35/105* (2013.01); *E05B 37/025* (2013.01); *E05B 35/00* (2013.01); *E05B 39/00* (2013.01); *Y10S 70/59* (2013.01); *Y10T 70/415* (2015.04); *Y10T 70/422* (2015.04); *Y10T 70/424* (2015.04); *Y10T 70/446* (2015.04); *Y10T 70/463* (2015.04); *Y10T 70/491* (2015.04); *Y10T 70/7141* (2015.04); *Y10T 70/7147* (2015.04); *Y10T 70/7407* (2015.04); *Y10T 70/7486* (2015.04); *Y10T 70/7576* (2015.04); *Y10T 70/7644* (2015.04); *Y10T 70/8027* (2015.04)

(58) Field of Classification Search

CPC ..... E05B 37/0031; E05B 37/0034; E05B 37/025; E05B 39/00; E05B 67/22; E05B 67/24; E05B 37/02; E05B 37/00; E05B 41/00; E05B 17/22; E05B 29/0026; E05B 35/105; E05B 35/00; Y10T 70/7141; Y10T 70/7486; Y10T 70/7147; Y10T 70/7407; Y10T 70/422; Y10T 70/463; Y10T 70/7576; Y10T 70/446; Y10T 70/415; Y10T 70/491; Y10T 70/8027; Y10T 70/424; Y10T 70/7644; Y10S 70/59

USPC ..... 70/21, 25, 26, 284, 285, 432–438, 70/DIG. 63, DIG. 71, 360, 368, DIG. 59, 70/38 R, 38 C, 387, 441, 361

See application file for complete search history.

(56) References Cited

U.S. PATENT DOCUMENTS 1,050,692 A * 1/1913 Resch ..... 70/100
1,819,813 A * 8/1931 Ellenberger ..... 70/19
1,835,130 A * 12/1931 Wread ..... 70/370

(Continued)

*Primary Examiner* — Lloyd Gall
(74) *Attorney, Agent, or Firm* — Rosenberg, Klein & Lee

(57) ABSTRACT

A lock includes a housing and a key-operated lock core mounted on the housing. The key-operated lock core has a spindle with a keyhole defined therein. The spindle is movable between an original position where the spindle is allowed to be rotated with respect to the housing to put the lock in a locked or unlocked state, and an indicative position where the spindle is also allowed to be rotated to put the lock in the locked or unlocked state.

13 Claims, 11 Drawing Sheets

(56) References Cited

U.S. PATENT DOCUMENTS

| | | | | | |
|---|---|---|---|---|---|
| 1,853,162 | A * | 4/1932 | Jacobi | 70/260 |
| 2,023,208 | A * | 12/1935 | Olson | 70/358 |
| 2,046,831 | A * | 7/1936 | Lowe | 70/369 |
| 2,313,711 | A * | 3/1943 | Jacobi | 70/145 |
| 2,573,061 | A * | 10/1951 | Raymond | 70/81 |
| 3,340,709 | A * | 9/1967 | Callahan | 70/209 |
| 3,600,916 | A * | 8/1971 | Ruppert | 70/432 |
| 3,726,115 | A * | 4/1973 | Wellekens | 70/33 |
| 3,863,475 | A * | 2/1975 | Foss | 70/360 |
| 3,921,422 | A * | 11/1975 | Walters | 70/97 |
| 4,418,554 | A * | 12/1983 | Wolfgang | 70/360 |
| 4,565,080 | A * | 1/1986 | Kincaid et al. | 70/215 |
| 5,295,377 | A * | 3/1994 | Moricz et al. | 70/379 R |
| 5,720,191 | A * | 2/1998 | Tsung-Chuan et al. | 70/38 A |
| 5,799,520 | A * | 9/1998 | Laabs et al. | 70/360 |
| 5,970,762 | A * | 10/1999 | Myers et al. | 70/492 |
| 6,109,081 | A * | 8/2000 | Dimig et al. | 70/492 |
| 6,178,789 | B1 * | 1/2001 | Finkelstein et al. | 70/210 |
| 6,701,761 | B1 * | 3/2004 | Chang et al. | 70/337 |
| 6,877,345 | B1 * | 4/2005 | Misner et al. | 70/25 |
| 7,003,994 | B2 * | 2/2006 | Ruan | 70/416 |
| 7,013,686 | B1 * | 3/2006 | Chen | 70/43 |
| 7,121,123 | B2 * | 10/2006 | Yu | 70/21 |
| 7,174,756 | B2 * | 2/2007 | Ling et al. | 70/284 |
| 7,434,426 | B2 * | 10/2008 | Loughlin et al. | 70/25 |
| 7,779,657 | B2 * | 8/2010 | Yu | 70/21 |
| 7,934,406 | B2 * | 5/2011 | Loughlin et al. | 70/25 |
| 8,011,212 | B2 * | 9/2011 | Yu | 70/21 |
| 8,353,184 | B2 * | 1/2013 | Ling et al. | 70/21 |
| 8,621,899 | B2 * | 1/2014 | Kuo et al. | 70/21 |
| 8,720,236 | B2 * | 5/2014 | Ling et al. | 70/21 |
| 2004/0226323 | A1 * | 11/2004 | Ling et al. | 70/25 |
| 2005/0155395 | A1 * | 7/2005 | Yu | 70/30 |
| 2005/0262902 | A1 * | 12/2005 | Ling et al. | 70/21 |
| 2006/0130540 | A1 * | 6/2006 | Lin | 70/21 |
| 2006/0225471 | A1 * | 10/2006 | Fernandez | 70/427 |
| 2006/0266084 | A1 * | 11/2006 | Kuo et al. | 70/21 |
| 2007/0125141 | A1 * | 6/2007 | Ling et al. | 70/284 |
| 2007/0157679 | A1 * | 7/2007 | Ling et al. | 70/21 |
| 2008/0264123 | A1 * | 10/2008 | Kuhnke et al. | 70/357 |
| 2008/0307839 | A1 * | 12/2008 | Yu | 70/330 |
| 2009/0007605 | A1 * | 1/2009 | Yu | 70/24 |
| 2013/0111958 | A1 * | 5/2013 | Kuo et al. | 70/21 |

* cited by examiner

LOCK HAVING AN INDICATORY LOCK CORE

CROSS REFERENCE TO RELATED APPLICATION

This is a continuation of application Ser. No.12/213,031 , filed on Jun. 13, 2008 , now U.S. Pat. No. 8,011,212.

BACKGROUND OF INVENTION

1. Field of Invention

This invention relates to a lock, and more particularly to a lock including an indicative lock core adapted both to lock/unlock the lock and to indicate whether the lock has been unlocked.

2. Related Prior Art

U.S. Pat. No. 6,877,345 and U.S. Pat. Pub. No.: 2005/0262902A1 each shows a lock including an indicator therein. The indicator is capable of being driven by a key-operated lock core of the lock to move to an indicative position, whereby it indicates to a user whether the key-operated lock core of the lock has been operated. However, the indicator occupies some of the space inside the lock and is also correlated with an increase in structural complexity.

SUMMARY OF INVENTION

This invention relates to a lock including a housing and an indicative lock core. The indicative lock core is configured to be activated by a key in order to lock/unlock the lock and to indicate whether the indicative lock core of the lock has been operated as to unlock the lock.

The indicative lock core includes a spindle. The spindle defines a keyhole for receiving the key.

Preferably, the indicative lock core is configured in a way that the spindle moves to an indicative position when the key is taken out from the keyhole.

Preferably, the indicative lock core is configured in a way that the spindle moves to the indicative position when the key is inserted into the keyhole.

Preferably, the indicative lock core is configured in a way that the spindle moves to the indicative position when the key drives the spindle to rotate.

In any case, when the spindle is in the indicative position, the spindle is partly situated outside the housing in order to demonstrate that the indicative lock core has been operated.

DETAILED DESCRIPTION OF EMBODIMENTS

Figure 1:
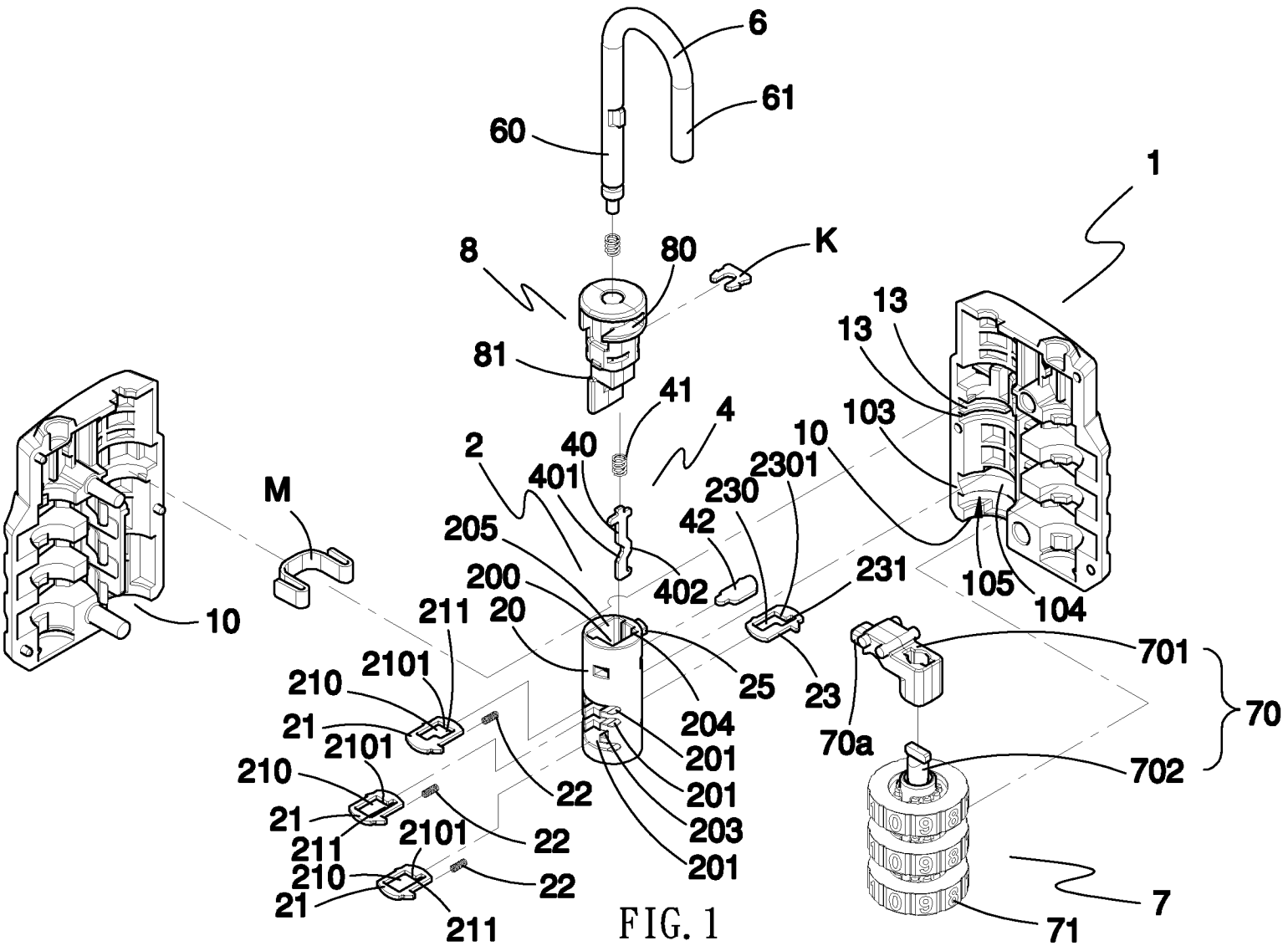
FIG. 1 is an exploded view of a padlock according to a first embodiment of the present invention.
Figure 2:
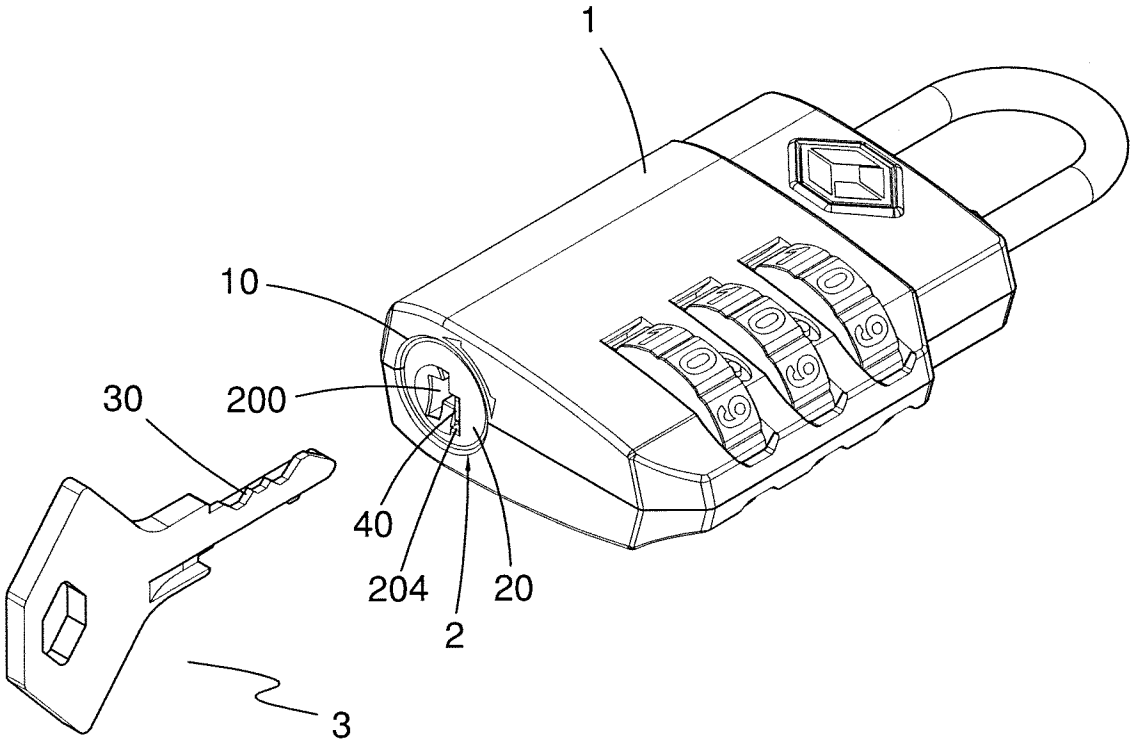
FIG. 2 is a perspective view illustrating an assembled padlock of FIG. 1 and a key.

Referring now to FIGS. 1 and 2 of the drawings, a lock in accordance with a first embodiment of the invention includes a housing 1 and an indicatory or indicative lock core 2. The housing 1 is composed of two half-shells and the two half-shells together define an opening 10 in a bottom. The indicative lock core 2 is disposed in the housing 1 and includes a spindle 20, a plurality of latch plates 21 and a plurality of springs 22.

The spindle 20 has a cylindrical shape and is normally received in the housing 1 with its end received in the opening 10. The spindle 20 is formed with a protrusion 25 on a side and defines a keyhole 200 therein and a plurality of latch slots 201 parallel to one another. The keyhole 200 is configured to receive teeth 30 of a key 3 which is mated with the indicative lock core 2. These latch slots 201 are vertically interconnected with the keyhole 200. These latch plates 21 together with the corresponding springs 22 are assembled in the latch slots 201 respectively. The latch plates 21 are biased by the springs 22 respectively in such a way that the latch plates 21 are normally partly situated outside the latch slots 201. In other situations, those latch plates 21 may bounce out of or draw back to the latch slots 201 as a result of the flexibility of the springs 22. In contrast, no spring abuts the blocking plate 23 so that the blocking plate 23 is freely received in the blocking slot 203.

Each of the latch plates 21 defines a hole 210 therein. When each latch plate 21 is assembled in the respective latch slot 201, the holes 210 are in alignment and communication with the keyhole 200. Inner plateaus 2101 of the holes 210 of the latch plates 21 are located in different height levels, some higher, some lower, and no two ones are situated in the same level, and that depends on shape of the teeth 30 of the key 3.

Figure 3:
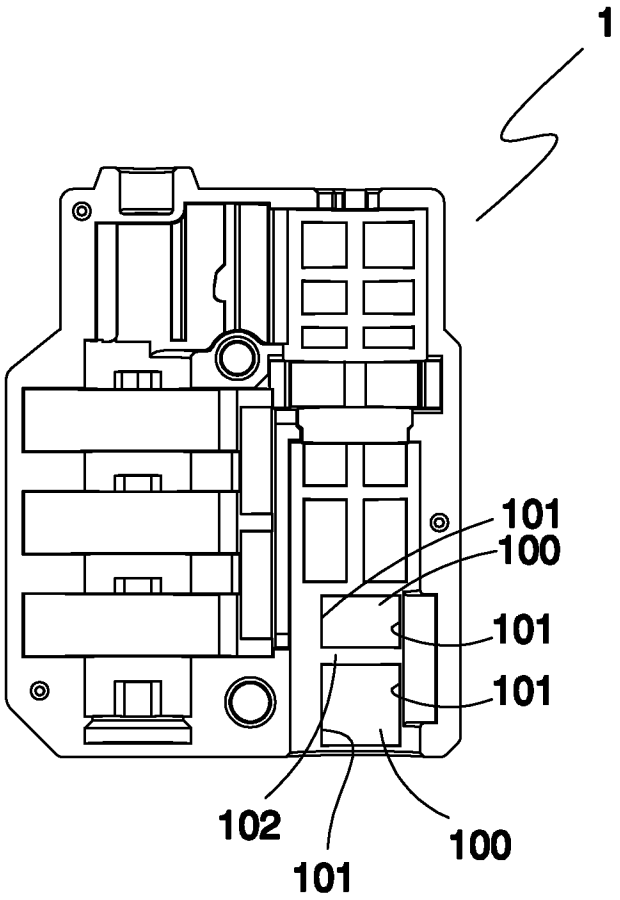
FIG. 3 is a perspective view of one half-shell of the padlock of FIG. 1.
Figure 5:
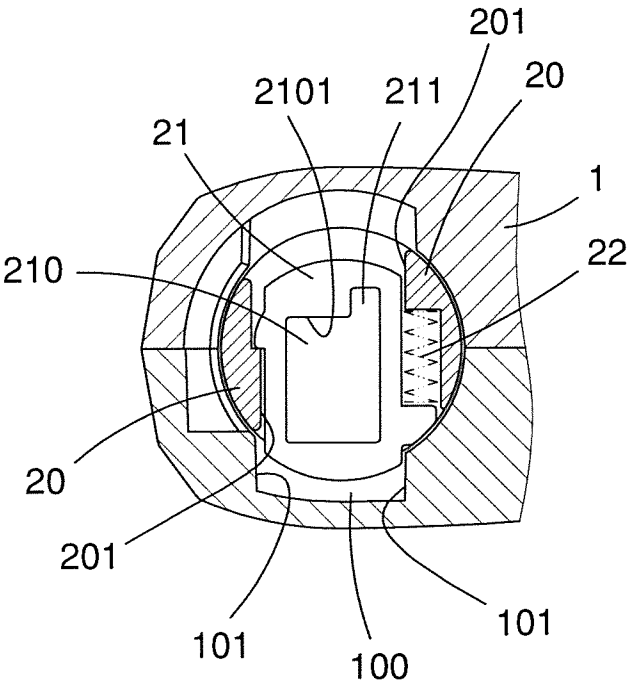
FIG. 5 is a fragmentary cross-sectional view illustrating an indicative lock core and a housing of the padlock of FIG. 2.
Figure 6:
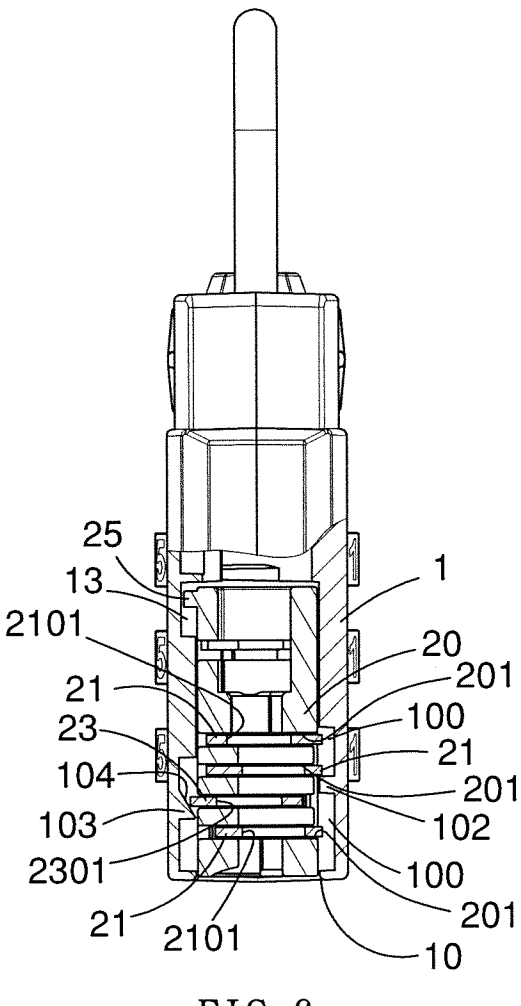
FIG. 6 is a side view, partially broken away to show details of construction, of the padlock of FIG. 2.

As shown in FIGS. 1 and 3, the housing 1 defines a room 100 corresponding to the latch plates 21 and has a ridge 102 dividing the room 100 into an upper section and a lower section. As shown in FIGS. 5 and 6, the latch plates 21 are mostly received in the latch slots 201 of the spindle 20 and partly exposed outside the spindle 20. Those exposed portions of the latch plates 21 are received in the room 100 and are confined by opposed side walls 101 of the room 100 in such a way that the spindle 20 is not allowed to rotate. In addition, as shown in FIG. 6, since at least one latch plate 21 is blocked by the ridge 102, the spindle 20 is not allowed to move linearly in a direction away from the opening 10 either.

Figure 4:
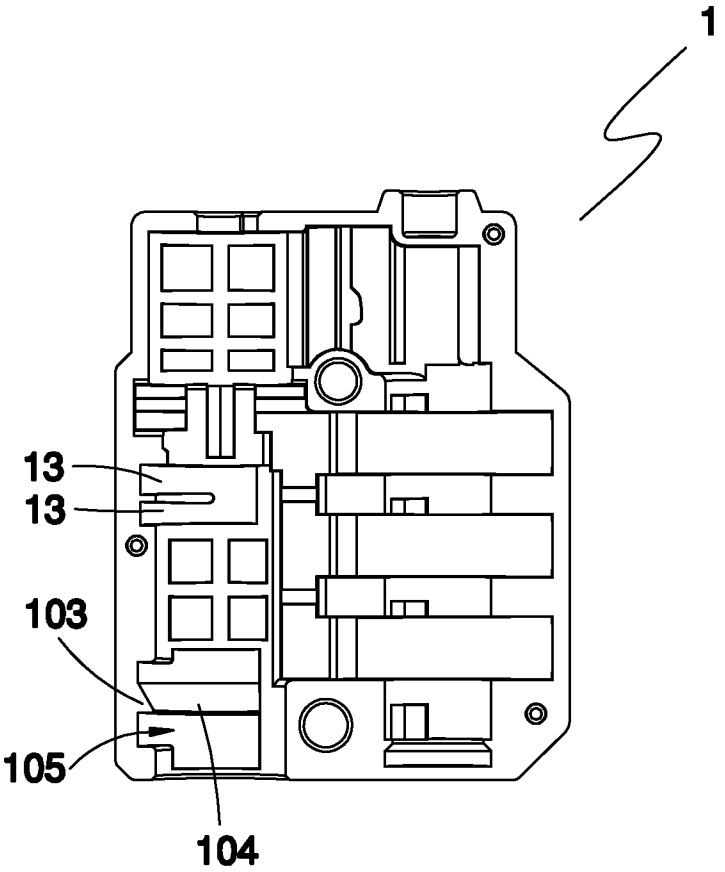
FIG. 4 is a perspective view of the other half-shell of the padlock of FIG. 1.

As shown in FIG. 1, the indicative lock core 2 further includes a blocking plate 23. The spindle 20 further defines a blocking slot 203 for receiving the blocking plate 23. The blocking slot 203 is in parallel with those latch slots 201 and vertically interconnected with the keyhole 200. The blocking plate 23 defines a hole 230. When the blocking plate 23 is assembled in the blocking slot 203, the hole 230 is in alignment/communication with the keyhole 200. An inner plateau 2301 of the hole 230 and the inner plateaus 2101 of the latch plate 21 are located on the same side. As shown in FIGS. 1 and 4, the housing 1 has a rib 103 corresponding to the blocking plate 23. The rib 103 has an incline 104.

Figure 7:
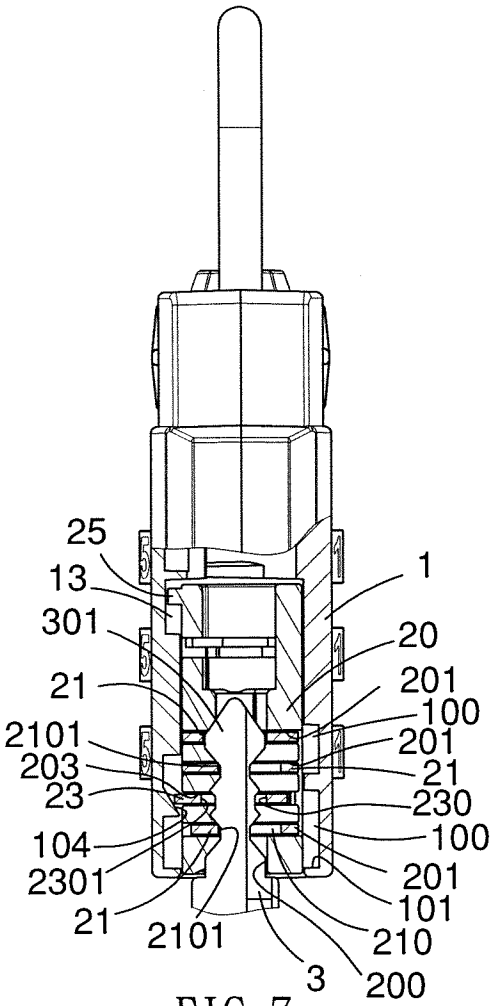
FIG. 7 is similar to FIG. 6, showing that the key is inserted into the padlock and the spindle of the padlock is allowed to be rotated.

As shown in FIG. 7, when the key 3 is inserted into the keyhole 200 and passes through all the holes 210 of the latch plates 21 and the hole 230 of the blocking plate 23, the latch plates 21 retract into the latch slots 201 from the room 100 of the housing 1 as a result of the inner plateaus 2101 of the latch plates 21 being pushed by the teeth 30 of the key 30. That is, the latch plates 21 are no more confined by the two opposite side walls 101 of the room 100. At this time, the spindle 20 is allowed to be rotated by the key 3 in order to unlock the lock.

Likewise, when the key 3 is inserted into the keyhole 200, the plateau 2301 of the blocking plate 23 is pushed by the teeth 30 to have the blocking plate 23 partly situated outside the blocking slot 203. Specifically, the teeth 30 have a highest awl-shaped protrusion 301. The plateau 2301 of the blocking plate 23 is pushed aside by the passing highest awl-shaped protrusion 301 when the key 3 is inserted into the keyhole 200. After being rotated by the key to unlock the lock, the spindle 20 can then be rotated reversely back to its original position by reverse operation of the key. When the spindle 20 is rotated to its original position via the key 3, the key 3 is allowed to be removed from the keyhole 200 of the spindle 20 so as to have each latch plates 21 be restored to its original state where each latch plates 21 is biased by the spring 22 and partly received in the room 100. At this time, the blocking plate 23 remains partly situated outside the blocking slot 203 and abutting against the incline 104 of the housing 1.

Figure 9:
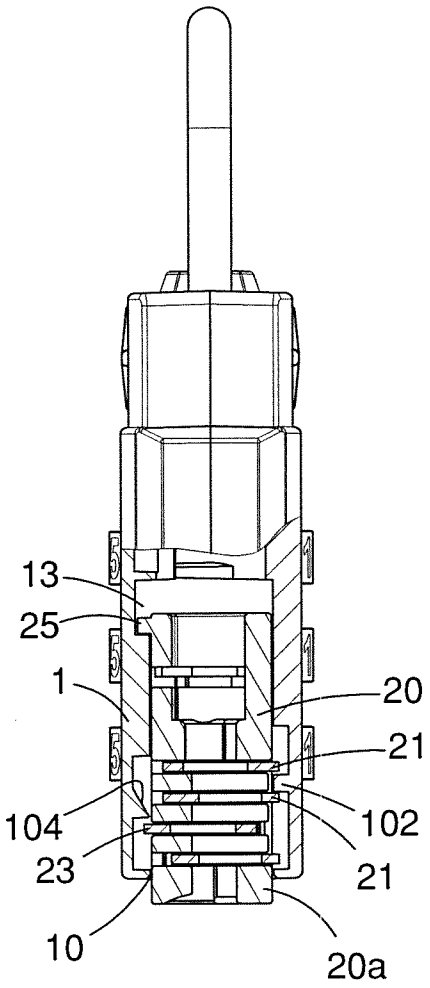
FIG. 9 is similar to FIG. 8, showing that the indicative lock core is partly exposed outside the housing.
Figure 8:
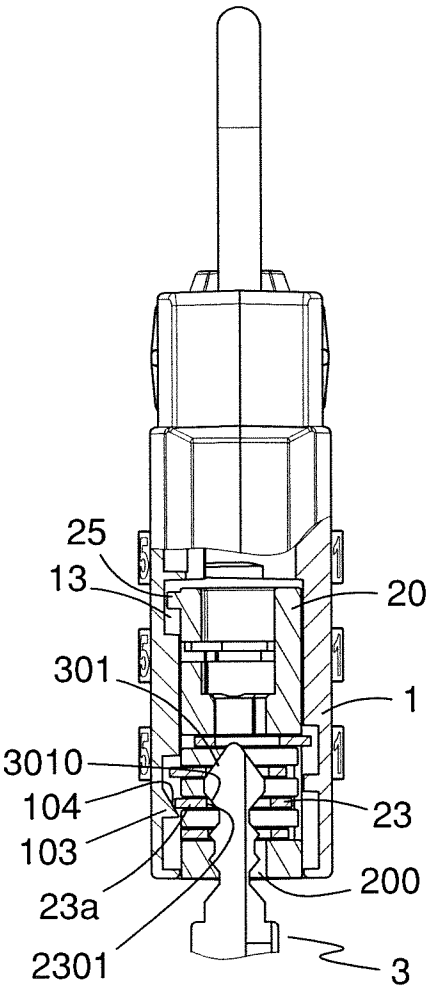
FIG. 8 is similar to FIG. 7, showing that the key is on the way out of the padlock.

As shown in FIG. 8, while the key 3 is drawn out of the keyhole 200 of the spindle 20, a distal end 23*a* of the blocking plate 23 is first slightly stuck in between an incline 3010 of the highest awl-shaped protrusion 301 and the incline 104 of the rib 103 so that the key 3 can grab and drag the spindle 20 to move together. When the distal end 23*a* of the blocking plate 23 moves with the spindle 20 downward and crosses over the incline 104 of the rib 103, the key 3 then pushes the blocking plate 23 aside via its incline 3010 so that the spindle 20, without the help of the blocking plate 23, is no more movable with the key 3 and remains in an indicative position, as shown in FIG. 9. Then, since the key 3 is no more kept by blocking plate 23, the key 3 may continue to completely move out of the keyhole 200 by itself.

As shown in FIG. 9, when the spindle 20 remains in the indicative position, a lower portion 20*a* of the spindle 20 is situated outside the housing 1. Because the ridge 102 of the housing 1 exactly gets stuck in between two of the latch plates 21, the spindle 20 is stuck and unable to be pushed back to its original position or drawn out further. At the time, it is understood that if the key 3 is re-inserted into the keyhole 200 of the spindle 20, the latch plates 21 of the spindle 20 will be drawn back to the respective latch slots 201, except the blocking plate 23 which is biased by no spring as mentioned above. Referring now to FIGS. 1 and 4 and giving special attention to an arc recess 105, which is defined in an inner wall of the housing 1 and under the rib 103, the recess 105 serves as an arc path for the blocking plate 23. In this way, when situated in the indicative position, the spindle 20 is still allowed to be rotated about its axis by operation of the key 3. However, no matter which position the spindle 20 is rotated to, the spindle 20 still stays in the indicative position and is prevented from returning back to the original position due to the blocking plate 23 being blocked by the rib 103. Referring now to FIG. 9 again, the portion 20*a* of the spindle 20 situated outside the housing 1 indicates that the spindle 20 has been operated by the key 3. To attract one's attention, the portion 20*a* of the spindle 20 may be painted with a color different from the color of the housing 1. Preferably, there is a contrast between the color of the whole spindle 20 and the color of the housing 1.

As shown in FIGS. 1 and 4, the housing 1 further defines a U-turn shaped channel 13. When the spindle 20 rotates or moves, the protrusion 25 of the spindle 20 moves along the channel 13.

As shown in FIGS. 1 and 2, the lock further includes a restoring device 4 configured to push the portion 20*a* of the spindle 20 back into the housing 1. To install the restoring device 4, the spindle 20 of the indicative lock core 2 further defines a restoring passage 204, each latch plate 21 defines a restoring hole 211, and the blocking plate 23 defines a restoring hole 231. The restoring passage 204 is parallel with the keyhole 200 and in communication with each other. When each latch plate 21 is assembled in the respective latch slot 201, the restoring holes 211 are exactly in alignment and communication with the restoring passage 204. When the blocking plate 23 is assembled in the blocking slot 203, the restoring hole 231 is exactly in alignment/communication with the restoring passage 204. The restoring device 4 includes a restoring plate 40, a spring 41 and a fixing plate 42. The restoring plate 40 has a cone recess 401 and an opposite cone protrusion 402 at the middle.

Figure 10:
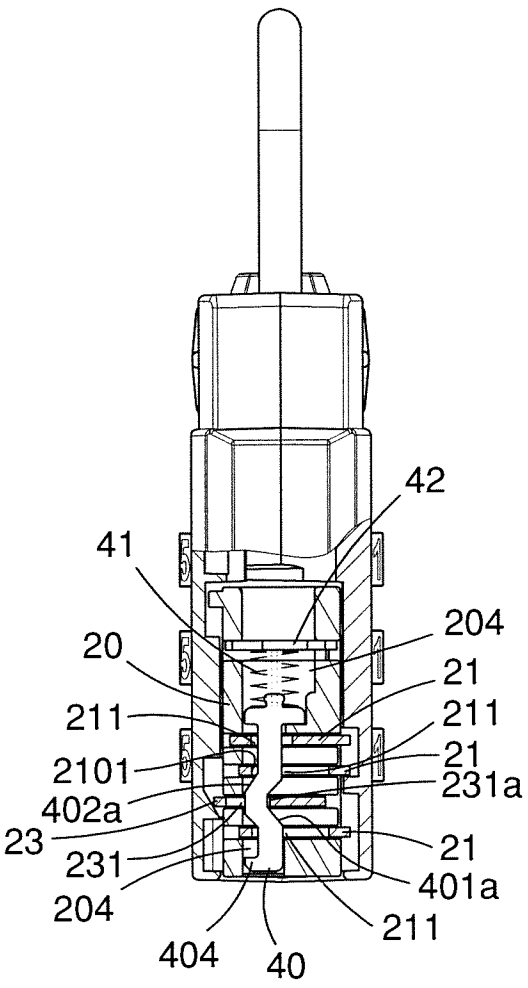
FIG. 10 is another side view, partially broken away to show details of construction, of the padlock of FIG. 2, showing that a restoring plate is included in the padlock.

As shown in FIG. 10, the restoring plate 40 is assembled in the restoring passage 204 and passes through the restoring holes 211 of the latch plates 21 and the restoring hole 231 of the blocking plate 23. The fixing plate 42 is lodged in the spindle 20 and across the restoring passage 204. The spring 41 is biased between the restoring plate 40 and the fixing plate 42. In particular, the restoring hole 231 of the blocking plate 23 is exactly aligned with the middle section of the restoring plate 40. An edge 231*a* of the restoring hole 231 of the blocking plate 23 abuts against a sidewall 401*a* of the cone recess 401. One of the latch plates 21 has its plateau 2101 abutting against a sidewall 402*a* of the cone protrusion 402.

Figure 11:
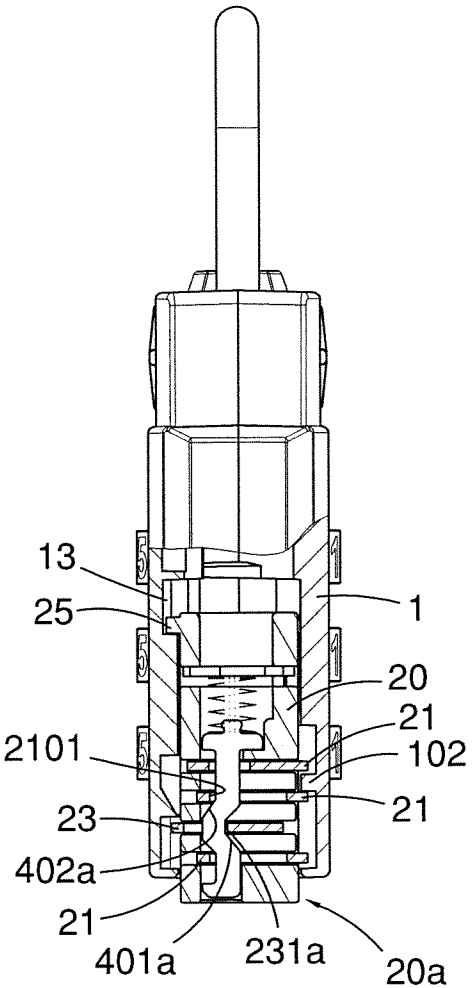
FIG. 11 is similar to FIG. 10, showing that the indicative lock core together with the restoring plate is partly exposed outside the housing.

FIG. 11 illustrates that the spindle 20 is dragged out by the key 3 in order to expose the portion 20*a* and is stuck in the indicative position. At this time, as mentioned above, the ridge 102 of the housing 1 is stuck in between the two latch plates 21. However, a relationship among the restoring plate 40, the latch plates 21 and the blocking plate 23 remains the same.

Figure 12:
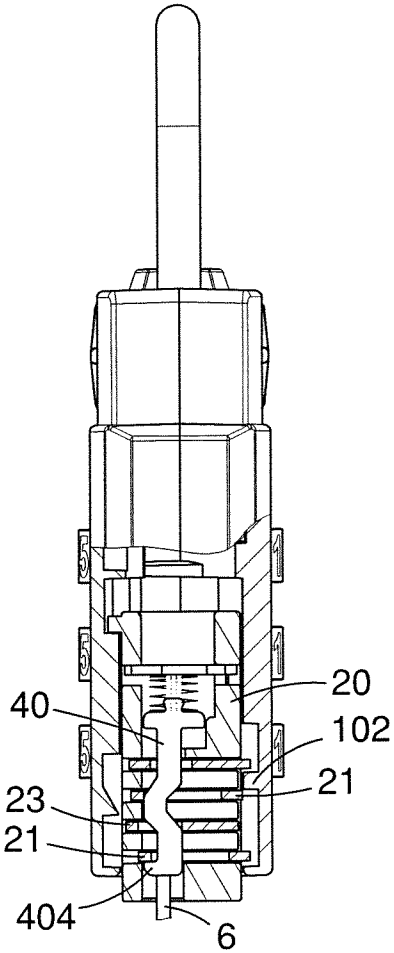
FIG. 12 is similar to FIG. 11, showing that the restoring plate is pushed back into the housing by an insert.

FIG. 12 illustrates that a tool 6, such as an elongated stem or a thin strip, is used to push the restoring plate 40 inward a bit. At this time, one of the latch plates 21, which is originally blocked by the ridge 102, and the blocking plate 23 are both pressed by the restoring plate 40 to retract, and a hook portion 404 of the restoring plate 40 contacts with a bottom of the lowest latch plate 21, and thereby the spindle 20 is in a state ready to be moved inward. The tool 6 can be pushed inward further so as to bring the spindle 20 completely into the housing 1, as shown in FIG. 10.

According to the above, the spindle 20 can be rotated by rotation of the key 30 so as to lock or unlock the lock. In particular, the spindle 20 can be dragged out and partly situated outside the housing 1 by drawing out the key 3 from the spindle 20 to indicate that the indicative lock core 2 has been operated or activated by the key.

As shown in FIG. 1, the lock is a padlock. That is, the lock includes a shackle 6. The shackle 6 has a root section 60 and a free section 61. The root section 60 is disposed in the housing 1. The free section 61 extends from the root section 60 and disposed outside the housing 1.

In order to become a dual lock, the lock further includes a combination lock core 7 and a controlling unit 8. The combination lock core 7 includes a movable part 70 and a plurality of numeral wheels 71. When a correct combination on the numeral wheels is dialed, the movable part 70 is allowed to move axially. When a wrong combination on the numeral wheels is dialed, the movable part 70 is locked and is not allowed to move axially. In this embodiment, the movable part 70 is composed of an upright stem 702 and a lateral stem 701 joined to the upright stem 702 in order that a distal end 70*a* of the movable part 70 can reach to the controlling unit 8.

The controlling unit 8 is disposed in the housing 1 and is able to rotate and move axially. The root section 60 of the shackle 6 is rotatably mounted on the controlling unit 8 via a U-shaped latch K so that the shackle 6 can rotate to enable its free section 61 to be close to or away from the housing 1. The controlling unit 8 is formed with a block 80 and a driving member 81. The driving member 81 is wedged in a notch or a recess 205 of the spindle 20 so that the driving member 81 together with other parts of the controlling unit 8 can rotate with the spindle 20, and thereby the spindle 20 can be used to drive the controlling unit 8. Moreover, the driving member 81 is capable of axially moving with respect to the recess 205 of the spindle 20. An elastic plate M, as shown in the figure, is mounted around the controlling unit 8 for elastically securing the controlling unit 8 when controlling unit 8 rotates.

Figure 14:
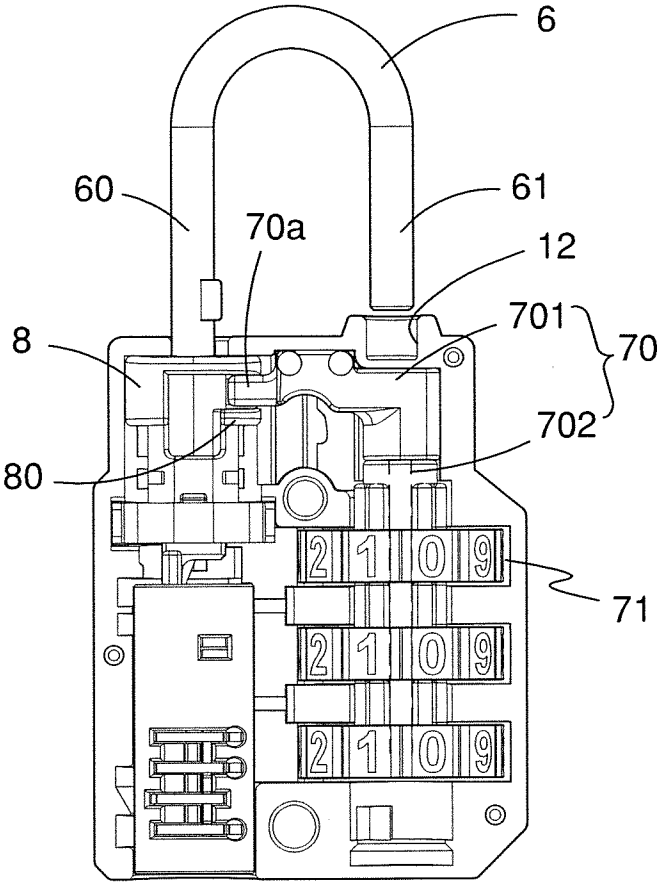
FIG. 14 is similar to FIG. 13, showing that a correct combination of the combination lock core of the padlock is entered and the shackle is lifted up to have the padlock enter into an unlocking state.
Figure 13:
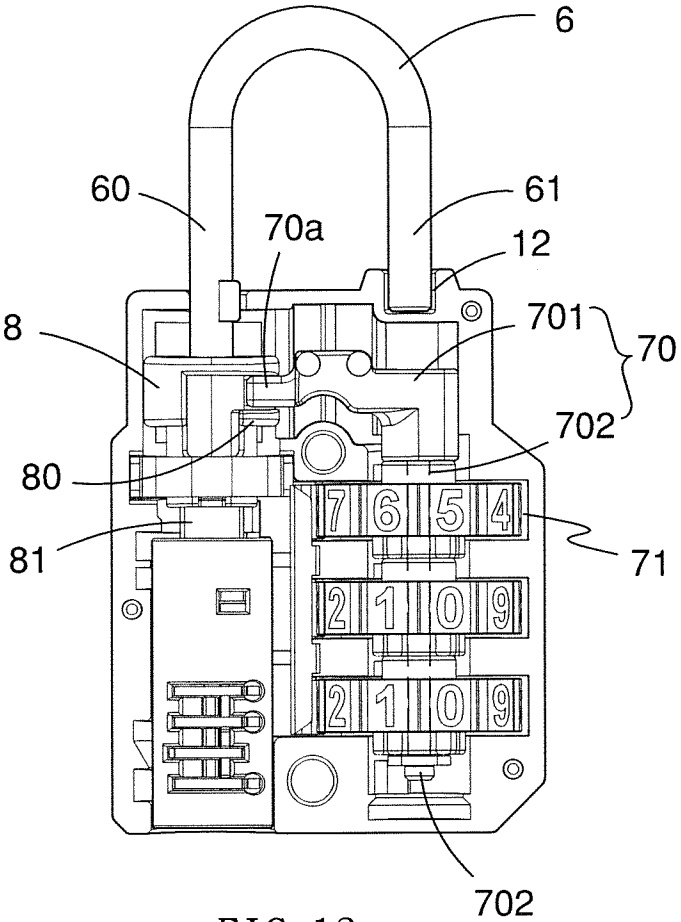
FIG. 13 is a schematic view of an inside of the padlock of FIG. 2, showing that the padlock is in a locking state.

FIG. 13 illustrates that the padlock is in a locking state. At this time, an end of the free section 61 of the shackle 6 is received in a locking hole 12 of the housing 1. The correct combination on the numeral wheels 71 is not entered yet so that the movable part 70 is not allowed to move axially. In this state, the block 80 of the controlling unit 8 together with the shackle 6 is not allowed to move axially due to obstruction of the distal end 70*a* of the movable part 70. As shown in FIG. 14, when the correct combination on the numeral wheels 71 is set and the movable part 70 is allowed to move axially, the free section 61 of the shackle 6 can be pulled away from the housing 1. Specifically, since the end 70*a* of the movable part 70 becomes movable, the controlling unit 8 and the movable part 70 are allowed to move axially with the shackle 6, and thereby the free section 61 of the shackle 6 can be released from the locking hole 12 of the housing 1 so as to have the padlock in an unlocking state.

Figure 16:
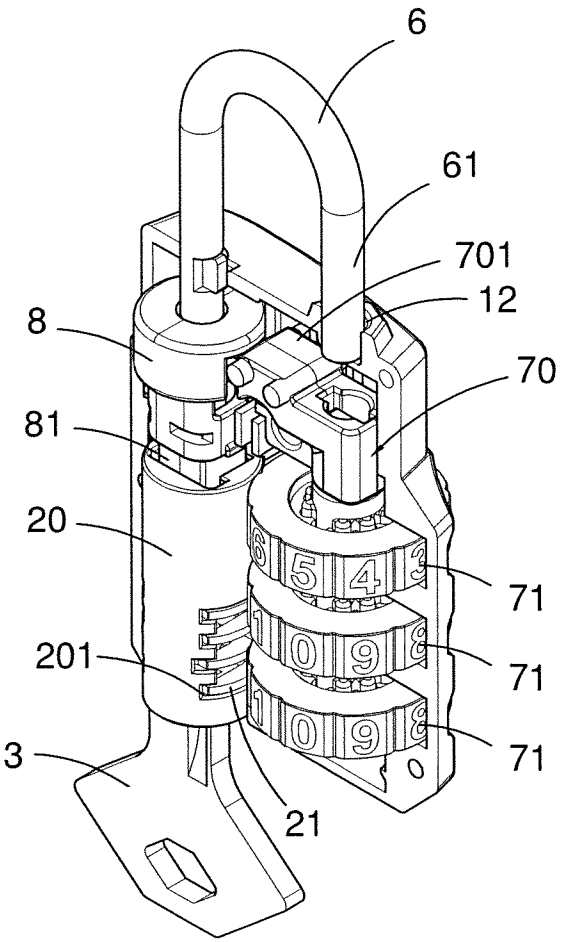
FIG. 16 is similar to FIG. 15, showing that the indicative lock core is driven to rotate by the key.
Figure 15:
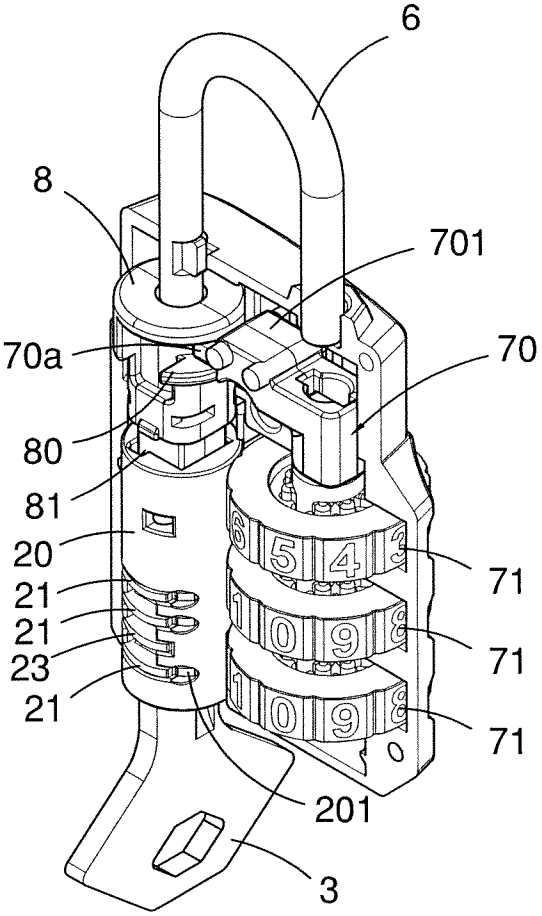
FIG. 15 is a partly perspective view of the padlock of FIG. 2, showing that the key is inserted into the indicative lock core of the padlock.
Figure 17:
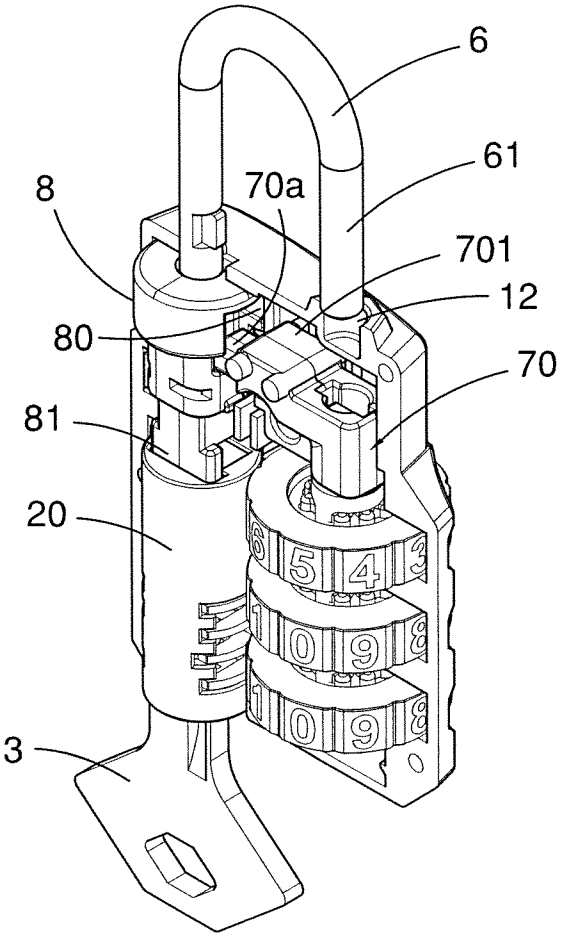
FIG. 17 is similar to FIG. 16, showing that the shackle of the padlock is lifted up.

FIGS. 15 and 16 show that the correct combination on the numeral wheels 71 is not entered so that the movable part 70 is not allowed to move axially. In FIG. 15, the key 3 has been inserted into the keyhole 200 of the spindle 20 to have the latch plates 21 retract into latch slots 201 and away from the room 100 of the housing 1 respectively. In the meantime, the spindle 20 is allowed to be rotated by the key 3 so as to drive the controlling unit 8 to rotate, as illustrated above. FIG. 16 illustrates that the controlling unit 8 has been rotated to a specific position where the block 80 is departed from the end 70*a* of the movable part 70 and is movable with respect to the movable part 70*a* so that the free section 61 of the shackle 6 is allowed to be pulled away from the housing 1. Specifically, since the end 70*a* of the movable part 70 obstructs the block 80 or other parts of the controlling unit 8 no more, the controlling unit 8 is allowed to move axially with the shackle 6 simultaneously to enable the free section 61 of the shackle 6 to be removed away from the locking hole 12 of the housing 1 so as to have the padlock enter in an unlocking state, as shown in FIG. 17.

As stated above, even if the correct combination on the numeral wheels 71 is not entered, the controlling unit 8 is movable axially by operation of the spindle 20 in order to have the free section 61 of the shackle 6 be released from the housing 1.

From the foregoing description, the present invention relates to a padlock provided with the indicative lock core to indicate whether the indicative lock core has been operated by a key. This kind of indicative lock core is applied to many types of locks. More particularly, the indicative lock core can move to an indicative position where the indicative lock core is partly exposed outside the housing.

In any case, one would understand that the present invention contains industrial applicability in view of the teachings of the foregoing description. Further, the present invention contains novelty because no prior art has been found to be the same with the present invention. Still further, the present invention contains non-obviousness because no prior art has been found to be similar to the present invention. Accordingly, the present invention fulfills the requirements for a utility patent and is filed herein for application.

The invention claimed is:

1. A lock comprising:

a housing (1);

a shackle (6) coupled to the housing (1), the shackle (6) being displaceable between closed and open positions with respect to the housing (1);

a lock core (2) reconfigurable responsive to key actuation to releasably lock the shackle (6) in the closed position, the lock core (2) including a spindle (20) formed with a top portion, a bottom portion, and a keyhole (200), wherein the spindle (20) is displaceably disposed in the housing (1), the spindle (20) being rotatable between a locking position and an unlocking position, and linearly moveable with respect to both the housing (1) and the shackle (6) between an original position and an indicative position, the bottom portion of the spindle (20) being inserted within the housing (1) in the original position and protruding from the housing (1) in the indicative position, wherein the keyhole (200) is configured to receive a key for turning the spindle (20) between the locking position and the unlocking position and initially moving the spindle (20) from the original position to the indicative position, the spindle (20) in the indicative position indicating prior actuation of the lock core (2) with the key, the spindle (20) being releasably locked in the indicative position, the shackle (6) being lockable in the closed position with the spindle (20) remaining in the indicative position.

2. The lock according to claim 1 wherein the spindle (20) is linearly moved into the indicative position from the original position responsive to the key being removed from the keyhole (200).

3. The lock according to claim 2 wherein the lock core further includes a spring-biased blocking plate (23) connected to the spindle (20), the spring-biased blocking plate (23) being biased to partially extend out of the spindle (20), the housing (1) further including a rib (103) formed on an internal side, wherein during the movement of the spindle (20) into the indicative position from the original position, the blocking plate (23) is retracted into the spindle (20) guided along a first portion of the rib (103), the blocking plate (23) partially extending out of the spindle (20) upon moving past the rib (103), the blocking plate (23) thereafter remaining blocked by a second portion of the rib (103) to keep the spindle (20) in the indicative position.

4. The lock according to claim 3 further comprising a restoring device (4) disposed in the spindle (20) and configured to upon displacement thereof retract the blocking plate (23) into the spindle (20), and thereby allow the spindle (20) to return to the original position.

5. The lock according to claim 2 wherein the shackle (6) includes a root (60) operatively connected to the spindle (20) in the housing (1) and a free end (61) extending from the root (60).

6. A lock comprising:

a housing (1);

a shackle (6) including a root (60) movably inserted in the housing (1) and a free end (61) extending from the root (60), the shackle (6) being displaceable between closed and open positions with respect to the housing (1);

a first lock core (2) reconfigurable responsive to key actuation to releasably lock the shackle (6) in the closed position, the lock core (2) including a spindle (20) formed with a top portion, a bottom portion, and a keyhole (200), wherein the spindle (20) is displaceably disposed in the housing (1), the spindle (20) being rotatable between a first locking position and a first unlocking position, and linearly moveable with respect to both the housing (1) and shackle (6) between an original position and an indicative position, the bottom portion of the spindle (20) being inserted in the housing (1) in the original position, the bottom of the spindle (20) protruding from the housing (1) in the indicative position, wherein in the keyhole (200) is configured to receive a key for turning the spindle (20) between the first locking and unlocking positions and initially moving the spindle (20) from the original position to the indicative position, the spindle (20) being linearly moved into the indicative position from the original position responsive to removal of the key from the keyhole (200), the spindle (20) is operatively coupled to the root (60), the spindle (20) being releasably locked in the indicative position, the shackle (6) being lockable in the closed position with the spindle (20) remaining in the indicative position; and a second lock core (7) movable in the housing (1) between a second locking position and second unlocking position, wherein the second lock core (7) prevents the root (60) from linear movement in the second locking position, wherein the second lock core (7) allows linear movement of the root (60) in the second unlocking position.

7. The lock according to claim 6 wherein the second lock core (7) comprises a movable element (70) operatively coupled to the root (60).

8. The lock according to claim 7 further comprising a controlling unit (8) connected to the movable element (70), the controlling unit (8) and the shackle (6) being thereby rotatable and linearly movable together, the controlling unit (8) and the spindle (20) being thereby rotatable together, wherein the root (60) remains linearly movable when the first lock core (2) is in the first unlocking position and the second lock core is in the second locking position.

9. The lock according to claim 8 wherein the controlling unit (8) includes a driving member (81), wherein the top portion of the spindle (20) of the first lock core (2) is formed with a notch (205) for receiving the driving member (81) of the controlling unit (8).

10. The lock according to claim 9 wherein the driving member (81) forms a flat element, wherein the notch (205) corresponds in shape to the driving member (81).

11. The lock according to claim 6 wherein the second lock core (7) is a combination lock core.

12. The lock according to claim 6 wherein the first lock core further includes a spring-biased blocking plate (23) connected to the spindle (20), the spring-biased blocking plate (23) being biased to partially extend out of the spindle (20), the housing (1) further including a rib (103) formed on an internal side, wherein during the movement of the spindle (20) into the indicative position from the original position, the blocking plate (23) is retracted into the spindle (20) guided along a first portion of the rib (103), the blocking plate (23) partially extending out of the spindle (20) upon moving past the rib (103), the blocking plate (23) thereafter remaining blocked by a second portion of the rib (103) to keep the spindle (20) in the indicative position.

13. The lock according to claim 12 further comprising a restoring device (4) disposed in the spindle (20) and configured to upon displacement thereof retract the blocking plate (23) into the spindle (20), and thereby allow the spindle (20) to return to the original position.

* * * * *